United States Patent [19]

Holce et al.

[11] 4,336,518

[45] Jun. 22, 1982

[54] PLUNGER OPERATED MAGNETIC CONTACT SWITCH ASSEMBLY

[75] Inventors: Thomas J. Holce, Portland; Charles M. Huckins, Tigard, both of Oreg.

[73] Assignee: Sentrol, Inc., Portland, Oreg.

[21] Appl. No.: 207,263

[22] Filed: Nov. 17, 1980

[51] Int. Cl.[3] ..... H01H 9/00

[52] U.S. Cl. ..... 335/205; 335/151

[58] Field of Search ..... 335/151, 152, 153, 154, 335/205, 206, 207

[56] References Cited

U.S. PATENT DOCUMENTS

| | | | |
|---|---|---|---|
| 3,932,718 | 1/1976 | Porat | 335/205 X |
| 4,126,841 | 11/1978 | Maeho | 335/205 X |
| 4,130,745 | 12/1978 | Hetzer | 335/205 X |

*Primary Examiner*—George Harris

*Attorney, Agent, or Firm*—Chernoff & Vilhauer

[57] ABSTRACT

A switch assembly which has an actuating magnet, held in one of a plurality of intersecting cavities within a reciprocally movable plunger, and a magnetic reed switch located alongside one another within a switch housing. With the actuating magnet in one position in the plunger the magnetic reed switch contacts remain normally open when the plunger is extended. With the actuating magnet in another cavity in the plunger, the magnetic reed switch contacts remain normally closed when the plunger is extended. The switch housing comprises a barrel including a cavity for receiving the magnetic switch and a guide cavity for receiving a plunger spring and guiding the reciprocal movement of the plunger. A cap of the housing retains a cylindrical roller against the plunger, and permits the roller to move reciprocally between an extended position projecting above the outer surface of the cap and a depressed position, moving the plunger and the actuating magnet carried in the plunger to change the state of the magnetic reed switch.

10 Claims, 9 Drawing Figures

FIG. 1
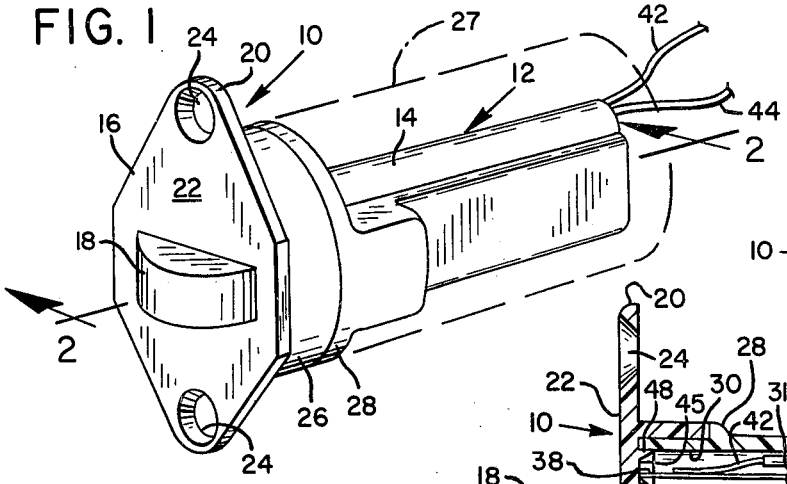
FIG. 4
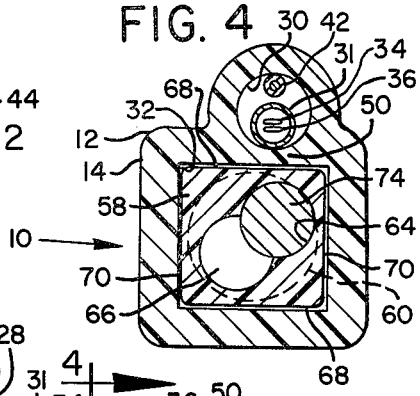
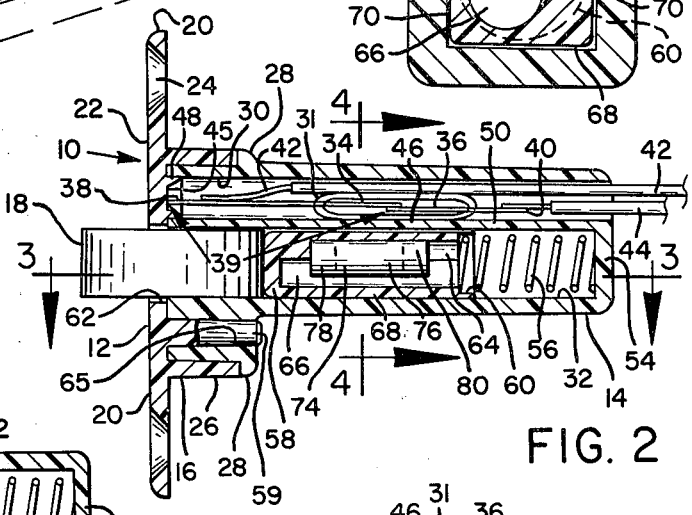
FIG. 2
FIG. 3
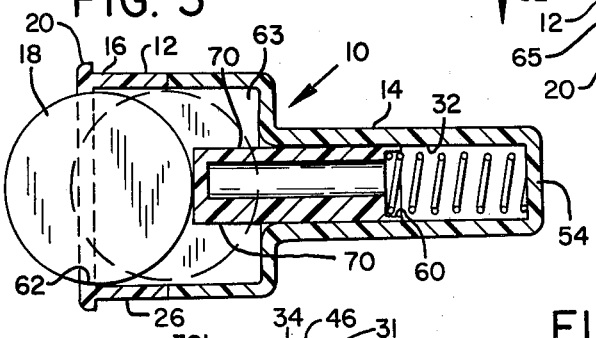
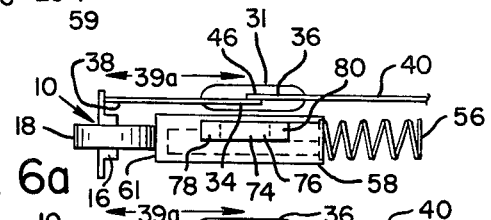
FIG. 6a
FIG. 7a
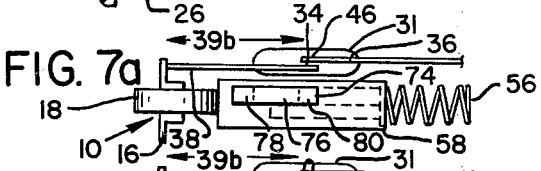
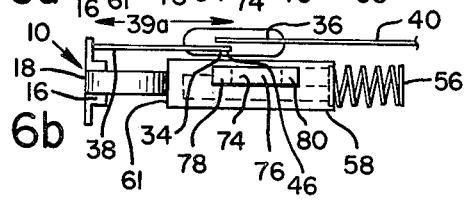
FIG. 6b
FIG. 7b
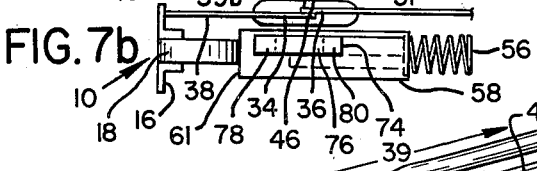
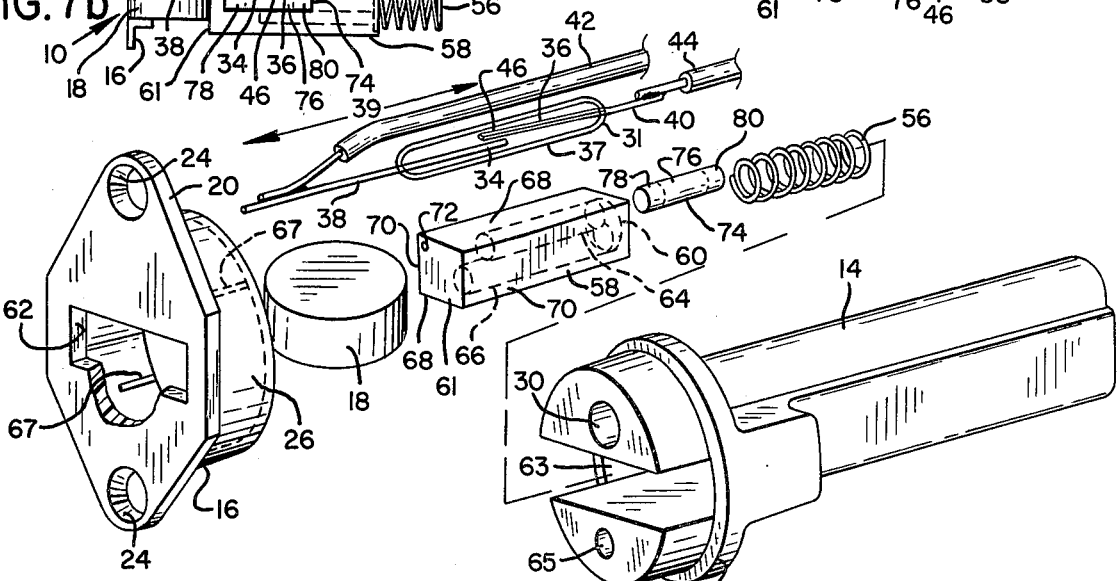
FIG. 5

PLUNGER OPERATED MAGNETIC CONTACT SWITCH ASSEMBLY

BACKGROUND OF THE INVENTION

The present invention relates to magnetic contact switches, and particularly to a switch assembly which may be assembled in alternative configurations to provide either normally closed or normally opened contacts.

Magnetic reed switches are normally capable of millions of cycles of operation before failure, since the contacts are not exposed to corrosive elements of the atmosphere and there are no bearings to fail. Encapsulated magnetic contact reed switches are often used for security systems and in position sensing applications, because of this longevity and reliability of such magnetic reed switches.

Use of such switches as proximity switches usually entails use of the magnetic field of an actuating magnet which is movable with respect to the switch itself, the actuating magnet being attached to one of two relatively movable objects, while the switch itself is mounted on the other. Such a separately mounted movable actuating magnet, however, must generally be considerably larger, and thus more costly, than the smallest magnet which would be required to actuate the same magnetic reed switch if placed immediately adjacent to the switch capsule.

An additional disadvantage to the use of an actuating magnet mounted separately on a moving part is that the sensitivity of the particular magnetic reed switch is an important factor in the performance of the security system or position monitoring system utilizing a magnetic reed switch actuated in this manner. Since a more sensitive magnetic reed switch can operated by a given actuating magnet at a greater distance, closely similar operating characteristics can be provided in a number of switch assemblies only by using switches of closely similar characteristics.

Because of the high cost of stable permanently magnetic material, it is economical to use the longevity of the reed switch by providing a small actuating magnet movably mounted in close proximity to the magnetic reed switch itself, along with a suitable mechanism, such as a plunger moved by mechanical contact with the object whose position is to be detected by the switch, for moving the actuating magnet.

While some use of this principle has been made in the past, as illustrated in Mayer, U.S. Pat. No. 3,243,544, and Yokoo, U.S. Pat. No. 3,260,821, the switch assemblies disclosed in those patents have disadvantages which make them unsuitable for use in security systems and certain other position sensing applications. For example, the construction of the Mayer switch would appear to make it vulnerable to wet weather, and the number and shape of magnets required in the Yokoo device make it unnecessarily expensive.

It is desirable in a magnetic reed switch assembly to have the option of using a single type of magnetic reed switch having a pair of contacts which are normally open, in either a normally open circuit or a normally closed circuit. The mechanism disclosed by Mayer for this purpose, however, is unnecessarily complex and susceptible to damage. In particular, the use of springs surrounding the magnetic reed switch capsules, as in the Mayer device, may provide undesirable magnetic field influence on the magnetic reeds. Additionally, the Mayer device requires the use of toroidal magnets fitting around the magnetic reed switch capsule, making the magnets unnecessarily expensive.

Yokoo discloses a magnetic reed switch assembly having a push rod operated carrier for moving an actuating magnet in a direction parallel with the length of the reeds of the reed switch to actuate the magnetic contacts. Yokoo, however, does not disclose any provision for assembly of the switch alternatively in normally open or normally closed contact modes. Additionally, the Yokoo switch requires an undesirably large amount of magnetic material, depending on the action of a pair of mutually attractive magnets to restore the actuating magnet to a normal position.

What is desired, then, is a switch assembly incorporating a single form of magnetic reed switch which may be utilized in either a normally open or a normally closed mode, which requires only a small permanent magnet, and which is simple in construction and manner of assembly.

SUMMARY OF THE INVENTION

The present invention overcomes many of the deficiencies and disadvantages of the previously known plunger operated magnetic contact switch assemblies by providing a switch assembly including a switch housing which protects the switch against water and other physical damage. The switch assembly of the present invention may be assembled for use in a normally open circuit or a normally closed circuit, as desired, and is easily mounted in a cylindrical cavity provided, for example, in a doorway frame or window frame.

The switch assembly of the invention includes a two-piece housing of which a barrel part includes a cavity for containing a magnetic reed switch, particularly one of the type having a pair of closely spaced resiliently flexible magnetic contacts extending toward one another from opposite ends of an elongate glass envelope. It also includes a plunger guide cavity for receiving a magnet-carrying plunger and guiding reciprocal movement of the plunger therein in a direction parallel to the length of the magnetic reed switch.

A small longitudinally polarized permanent magnet, when carried in the plunger, is located closely alongside and parallel to the magnetic reed switch, in a predetermined position with respect to the overlapping portions of the magnetic reeds of the reed switch, where it may induce opposite magnetic polarity in the overlapping portions of the magnetic reeds. When either end of the magnet is very close to the overlapping portion of the reeds the magnetic attraction between the reeds is too small to move the reeds together. When the center of the magnet is alongside the overlapping portion the polarities of the reeds are different, causing them to attract one another and close the switch contacts. Sufficient longitudinal relocation of the magnet as it is carried by the plunger changes the magnetic field induced in the reeds, thus closing the contacts or permitting them to open, as the case may be.

A spring contained within the barrel urges the plunger toward a roller detained by a cap which closes one end of the barrel. The cap permits reciprocal movement of the roller between an extended position, in which it projects from the cap, and a depressed position, in which the roller is received within the switch housing, flush with the outer surface of the cap.

The plunger, reciprocally movable within the plunger guide cavity in the barrel of the housing, includes a pair of intersecting magnet holding cavities. A small elongate longitudinally polarized permanent magnet is held in a selected one of the magnet holding cavities closely alongside and aligned parallel to the reed switch to actuate the reed switch in response to movement of the plunger by the roller or the spring.

The intersecting cavities within the plunger are of different depths. When the permanent magnet is in a first one of the cavities in the plunger it will provide a magnetic field which closes the magnetic reed switch contacts when the plunger is in its depressed position, as when a door or window monitored by the device is correctly closed against the roller. A predetermined amount of extension of the plunger will permit the switch to open. With the permanent magnet in the other of the cavities of the plunger the magnetic reed contacts will be separated when the plunger is in its depressed position, but a predetermined amount of extension will close the contacts.

In either case the amount of plunger motion possible before changing the switch is determined primarily by the length of the permanent magnet. Only a small pole portion at each end of the magnet permits the contacts of the reed switch to open when the pole portion is alongside the overlapping portions of the magnetic contacts. The sensitivity of the magnetic reed switch itself, within fairly wide limitations, is thus made to be a very small factor in the response of the device to a given displacement of the plunger.

It is therefore principal object of the present invention to provide a switch assembly which may be assembled selectively for providing either a normally open circuit or a normally closed circuit.

It is another important objective of the present invention to provide a switch assembly having the advantages of a magnetic contact switch yet requiring a minimum amount of magnetic material for switch actuation.

It is another important objective of the present invention to provide a switch assembly which is compact in size and simple to assemble.

It is a further objective of the present invention to provide a switch assembly capable of providing uniform response to a given amount of plunger movement despite inclusion of magnet reed switches of a range of sensitivities.

It is yet a further objective of the invention to provide a plunger operated switch assembly having switch contacts which are protected in a completely sealed enclosure.

It is a principal feature of the present invention that it provides a plunger operated switch assembly incorporating a plunger including a plurality of cavities for receiving an elongate actuating magnet in alternative positions for providing different operational characteristics of the assembled switch.

It is another important feature of the present invention that the distance of plunger travel possible without changing the state of the magnetic reed switch contacts may be varied by the use of actuating magnets of different physical length.

It is another feature of the present invention that it provides a switch assembly which is easily assembled in alternative configurations providing different modes of operation.

It is a primary advantage of the present invention that it may be manufactured more cheaply than previously known position sensing switches incorporating magnetic reed switches.

It is another important advantage of the present invention that it permits the use of magnetic reed switches of widely varying sensitivities in switch assemblies having similar operating characteristics, unlike previously known switch assemblies, in which differences in magnetic reed contact sensitivity result in differences of operating characteristics of the switch assembly.

It is another advantage of the present invention that it provides the advantages of a magnetic reed switch over a mechanically operated switch, yet is easier to install than when the actuating magnet must be separately mounted.

Yet a further advantage of the switch assembly of the present invention is that it is simpler to assemble than previously known switch assemblies which are capable of use for either normally open or normally closed circuits.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view of the switch assembly of the invention.

FIG. 2 is a sectional side view of the switch assembly of FIG. 1, taken along line 2—2.

FIG. 3 is a sectional top view of the switch assembly of FIG. 1, taken along line 3—3 of FIG. 2.

FIG. 4 is a sectional view of the switch assembly of FIG. 1, taken along line 4—4 of FIG. 2.

FIG. 5 is an exploded pictorial view of the switch assembly of FIG. 1.

FIGS. *6a* and *6b* are schematic views of the switch assembly of FIG. 1, assembled in the configuration providing normally closed switch contacts.

FIGS. *7a* and *7b* are schematic views of the switch assembly of FIG. 1, assembled in the configuration providing normally open switch contacts.

DETAILED DESCRIPTION OF THE INVENTION

Referring first to FIGS. 1–5 of the drawings, an exemplary switch assembly 10 which embodies the present invention is shown pictorially in FIG. 1. The switch assembly 10 comprises a housing 12 including a barrel 14 and a cap 16. A generally cylindrical roller 18, which could be described as a thick disc, is retained by the cap 16 and protrudes radially outward from within the cap to be moved inward by physical contact to operate the switch assembly 10. The cap 16 has a mounting flange 20 with an outer surface 22 facing away from the barrel 14. Mounting screw holes 24 are provided in the flange 20.

Extending rearwardly behind the flange 20 is a cylindrical portion 26 of the cap 16, into which a portion of the barrel 14 fits tightly, with a rim 28 of the barrel 14 in abutment against the cylindrical portion 26. The diameter of the cylindrical portion 26 and the rim 28 is slightly greater than that of the roller 18, in order to receive the roller 18. The remainder of the barrel 14 is smaller than the cylindrical portion 26 and rim 28. Accordingly, the housing may be mounted in a cylindrical hole of sufficient depth which is large enough to receive the cylindrical portion 26 of the cap 16, such as a hole of the size indicated by broken line at 27 in FIG. 1.

As may be seen in FIG. 2, the barrel 14 comprises a tubular switch cavity 30 which houses an encapsulated magnetic reed switch 31. Adjacent and parallel to the switch cavity 30 is a plunger guide 32, which is a generally rectangular cavity within the barrel 14.

The reed switch 31 includes a pair of magnetic contacts, at least one of which is movable, such as the flexible magnetic reeds 34 and 36 which extend toward one another from the opposite ends of a generally cylindrical capsule 37. Reed terminals 38 and 40, connected respectively to the reeds 34 and 36, extend outwardly through the capsule 37. A conductor 42 is electrically connected, for example by soldering, to the reed terminal 38, and a conductor 44 is connected electrically to the reed terminal 40, to incorporate the magnetic reed switch in an electrical circuit.

The reed terminal 38 is preferably cut to a predetermined length 39 as measured from the center of an overlapping zone 46 in which the free ends of the opposed magnetic reeds 34 and 36 overlap one another within the reed switch capsule 37. An interior bottom surface 45 is included in a short hollow plug portion 48 of the cap 16, which extends within the open end of the switch cavity 30. Location of the reed terminal 38, then, with its end in contact with the bottom surface 45 accurately locates the overlapping portion 46 of the magnetic reeds 34 and 36 with respect to the length of the switch cavity 30.

As may be seen in FIGS. 2 and 4, the magnetic reed switch 31 is preferably located within the switch cavity 30 closely adjacent to an interior wall 50 which defines one side of the plunger guide 32 included within the barrel 14. An epoxy or other potting material may be used to securely hold the reed switch 31 in place.

A solid rear wall 54 of the plunger guide 32 supports an end of a helical plunger spring 56. The other end of the helical spring 56 is in contact with a plunger 58, preferably fitting within a cylindrical recess 60 defined within one end of the plunger 58, which is disposed for reciprocal movement within the plunger guide 32. The spring 56 urges the outer or front end 61 of the plunger 58 into contact with the cylindrical roller 18, holding part of the roller 18 projecting outwardly beyond the outer surface 22 of the cap 16 unless an opposite force is applied.

As may be seen particularly in FIG. 3, an opening 62 defined within the cap 16 holds the roller 18 with its central axis approximately parallel to the outer surface 22 of the cap 16. The opening 62 permits nearly half of the roller 18 to protrude through the cap 16 beyond the outer surface 22, yet retains the roller 18 within the cap. A roller pocket 63 included in the barrel 14 permits the roller 18 to be moved into the housing 12 to a position flush with the outer surface 22 of the cap 16, in turn forcing the plunger 58 further within the plunger guide 32.

A locating dowel 59 projects rearwardly from the flange 20, within the cylindrical portion 26, and fits within a locating aperture 65 defined in the barrel 14 to assist in aligning the cap 16 with the barrel 14 during assembly of the housing 12. A plurality of small inwardly projecting ridges 67 are provided at intervals around the interior of the cap 16 (FIG. 5), providing an interference fit of the cap 16 over the end of the barrel 14.

Within the plunger 58, as may also be seen in FIGS. 4 and 5, a pair of intersecting generally cylindrical magnet receiving cavities, a shallow magnet receiving cavity 64 and a deep magnet receiving cavity 66, extend away from the recess 60 toward the outer or front end 61 of the plunger 58. The cylindrical magnet receiving cavities 64 and 66 are radially offset from one another and intersect one another, with the central axes of the two magnet receiving cavities 64 and 66 being located along a generally diagonal plane within the plunger 58. The plunger 58 is generally rectangular in cross section, but has pairs of opposite sides 68 and 70 of differing width, permitting the plunger 58 to be inserted into the plunger guide 52 in either one of only two possible different positions.

Depending upon the configuration desired for the assembled switch assembly 10, the plunger 58 may be located within the plunger receiving guide 32 to place either the shallow magnet receiving cavity 64 or the deep magnet receiving cavity 66 closely adjacent to the wall 50 and the switch receiving cavity 30. It will be noted that the switch receiving cavity 30 is located in a slightly offset position so that the switch 31 is aligned parallel with and closely adjacent to one of the magnet receiving cavities 64 or 66. An indicium such as a raised mark 72 (FIG. 5) located on the front end 61 of the plunger provides a ready indication of which of the magnet cavities 64 and 65 is located closely adjacent to the switch receiving cavity 30.

A cylindrical magnet 74 fits snugly within the selected one of the magnet receiving cavities in the plunger 58, as, for example, the shallow cavity 64, in FIGS. 2 and 4. The magnet 74 is longitudinally polarized, having a magnetic pole at each end. For purposes of explaining operation of the invention, however, although the magnet 74 is a single element, it will be described as comprising three parts, a center section 76, and two end portions 78 and 80.

Referring now to FIGS. *6a* and *6b*, the plunger operated switch of the invention is shown somewhat schematically, with the magnet 74 located in the shallow magnet receiving cavity 64 and the magnetic reed switch 31 located in proper relationship thereto to provide a plunger operated switch assembly 10 in which the magnetic reeds 34 and 36 are closed when the roller 18 and plunger 58 are extended. In this configuration, when the roller 18 and plunger 58 are extended, the center section 76 of the cylindrical magnet 74 is aligned alongside and proximate to the overlapping zone 46 of the reeds 34 and 36, and the magnetic field surrounding the magnet 74 induces one magnetic polarity in the end of the reed 34 and the opposite polarity in the reed 36. The opposite polarity of the reeds 34 and 36 causes them to attract one another, holding them in physical and electrical contact with one another, thus forming an electrical path through the switch 31.

If, however, as shown in FIG. *6b*, the roller 18 is depressed, moving the plunger 58 to carry the magnet 74 toward the bottom 54 of the plunger guide 32, the end portion 78 of the magnet 74 moves into a position aligned alongside and proximate to the overlapping portion 46 of the reeds 34 and 36, and the reed 36 extends along nearly the entire length of the magnet 68. Only a very small portion of the reed 34 is then alongside any portion of the magnet 74, and the magnetic attraction between the reeds 34 and 36 is too small to hold them flexed toward one another. The elastic resilience of the reeds causes them to separate from each other, breaking the electrical path through the reed switch 31.

The construction of the switch assembly 10 of the invention also permits the same components to be assembled to provide a switch which is normally electrically open when the roller 18 projects outwardly from the flange 20, as may be seen in FIGS. *7a* and *7b*. In FIG. *7a*, the roller 18 is extended and the spring 56 holds the plunger 58 against the roller 18. The magnet 74 is located in the deep magnet receiving cavity 66, and the plunger 58 has been inserted in the plunger guide 32 in a position rotated 180 degrees from that previously shown in FIGS. *6a* and *6b*, so that the deep magnet receiving cavity 66 is closely adjacent to the switch receiving cavity 30.

The magnetic reed switch is located within the switch receiving cavity so that the distance 39*b* between the overlapping zone 46 of the magnetic reed switch 32 and the bottom surface 45 is slightly greater than the distance 39*a* in FIGS. *6a* and *6b*. The end portion 80, the portion of the magnet 74 which is furthest from the cap 16, is aligned alongside and proximate to the overlapping portion 46 of the magnetic reeds 34 and 36. As a result, the magnet 74 induces insufficient attraction between the reeds 34 and 36 to move them, allowing them to remain separated from one another and keep the electrical circuit broken.

Upon depression of the roller 18 toward the interior of the roller pocket 63, the roller 18 forces the plunger 58 inwardly toward the bottom 54 of the plunger guide 32, carrying the magnet 74 in the same direction. As the magnet 74 moves inwardly, the center section 76 of the magnet 74 is brought alongside and proximate to the overlapping zone 46 of the reeds 34 and 36, and the magnetic field of the magnet 74, as in FIG. *6a*, induces attracting dissimilar polarities in the ends of the reeds 34 and 36, causing them to flex toward and into physical and electrical contact with one another, closing the electrical circuit through the magnetic reed switch 32.

By trimming the terminal wire 38 to vary the distance 39, by which the overlapping zone 46 is separated from the cap 16, the relative positions of the magnet 74 and the overlapping zone 46 of the reeds 34 and 36 can be varied by more than the difference in depth between the magnet receiving cavities 64 and 66. This permits conversion between normally open and normally closed configuration using a shorter housing 12 than would otherwise be possible, and permits accommodation of actuating magnets of differing lengths.

It also becomes possible, using a short magnet and a relatively long range of motion of the roller 18 and plunger 58, to assemble the switch assembly 10 to provide open contacts when the plunger 58 is either fully extended or fully depressed, and closed contacts with the roller 18 and plunger 58 in an intermediate position. Assembly with such a short magnet is also possible to provide the opposite action by using a short distance 39 and the shallow magnet cavity 64, so that the center section 76 of the magnet 74 lies alongside the overlapping zone 46 when the plunger 58 is extended and the entire magnet 74 is alongside the reed 36, with the end portion 78 slightly beyond the overlapping zone 46. In this configuration the contacts of the reed switch 31 will be open only when the plunger is between the fully extended and the fully depressed positions.

In a preferred embodiment of the invention, the roller 18 is slightly more than 0.6 inches in diameter and extends slightly less than 0.3 inches from the outer surface 22 when extended. In this embodiment of the invention, a magnet 74 is made preferably of a magnetic material of high retentivity, such as an Alnico alloy, in the form of a cylinder approximately 0.5 inches long and 0.125 inches in diameter. When the switch assembly 10 is assembled, the magnet 74 is located only about 0.07 inch from the capsule of the magnetic reed switch. With the magnet 74 this close to the encapsulated reed switch, so long as either end portion 78 or 80, the part of the magnet within approximately 0.1 inch of its end, lies aligned alongside and proximate to the center of the overlapping zone 46 of the reeds 34 and 36, the reeds will remain separated from one another. However, when the center section 76 of the magnet, the portion more than 0.1 inch from either end of the magnet, is located proximate to the overlapping portion 46 of the reeds 34 and 36, the reeds 34 and 36 are magnetically oppositely polarized and attract one another, flexing into electrical contact with each other.

Magnetic reed switches responsive to magnetic fields in the range of ten to forty ampere-turns respond nearly identically when used in the above-described embodiment of the invention. Thus magnetic reed switches having a wide range of operating characteristics to be used in production of switch assemblies having closely similar operating characteristics.

Switch assemblies can be manufactured according to the present invention to reliably open and close within 0.020 to 0.030 inch from a nominal switching position in which the roller 18 is mid-way between fully extended and flush with the outer surface 22 of the flange 16, with any individual switch assembly 10 able to operate repeatedly within 0.010 inch of a single position when the roller 18 is either being depressed or being allowed to extend. Such a switch assembly is particularly reliable and therefore usable in industrial position sensing applications, where it is often desired to repeatedly sense a position to an allowable error of 0.01 inch.

To accommodate use of a plunger switch assembly in security system circuits of either the "closed loop" or "open loop" type, the alternative modes of assembly of the device of the invention permit the use of a single type of magnetic reed switch 31, having magnetic contacts which are normally separated, in plunger operated switch assemblies 10 whose magnetic contacts are either open or closed, as desired, when the plunger 58 is extended. The close proximity of the magnet 74 to the magnetic reed switch 31, in the switch assembly 10 of the present invention, provides switch operation at a clearly defined location of the roller 18 and plunger 60, without requiring the use of large amounts of permanently magnetic material.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A plunger operated electrical switch assembly, comprising:

(a) a magnetic reed switch;

(b) means for holding said magnetic reed switch in a predetermined position;

(c) a plunger;

(d) a plunger guide located adjacent said means for holding said magnetic reed switch, said plunger guide permitting reciprocal movement of said plunger alongside and longitudinally of said magnetic reed switch, between a predetermined extended position and a depressed position;

(e) an elongate actuating magnet; and (f) cavity means defined in said plunger for holding said actuating magnet in one of a plurality of predetermined positions relative to said magnetic reed switch when said plunger is in said extended position, said cavity means including a plurality of intersecting similarly oriented magnet receiving cavities, each including means for positively establishing a different predetermined location for said actuating magnet within said plunger.

2. The switch assembly of claim 1, said magnetic reed switch having a pair of magnetic contacts extending toward one another, said contacts having an overlapping zone, said elongate actuating magnet including two spaced apart opposite magnetic poles located at respective opposite end portions thereof and a center section located between said opposite magnetic poles, said plurality of intersecting cavities consisting of a first cavity and a second cavity, said first cavity having a predetermined depth establishing a first predetermined position for said magnet with respect to said plunger, wherein one of said end portions of said magnet is proximate to said overlapping zone when said plunger is in said depressed position and said center section of said magnet is proximate to said overlapping zone when said plunger is in said extended position, and said second cavity having a predetermined different depth establishing a second predetermined position for said magnet with respect to said plunger, wherein said center section of said magnet is proximate to said overlapping zone when said plunger is in said depressed position and one of said end portions of said magnet is proximate to said overlapping zone when said plunger is in said extended position.

3. The switch assembly of claim 2 wherein said means for holding said magnetic reed switch comprises an elongate tubular cavity, located adjacent said plunger guide and aligned parallel to the direction of plunger movement defined by said plunger guide, and includes interior bottom surface means for establishing the location of said overlapping zone of said magnetic reed switch contacts within said means for holding said magnetic reed switch.

4. The switch assembly of claim 1, said plunger guide and said means for holding said magnetic reed switch being incorporated in a housing, said housing including mounting flange means for facilitating mounting of said switch assembly in a desired location.

5. The switch assembly of claim 1 further including housing means for protectively containing said means for holding said magnetic reed switch and said plunger guide, said housing means comprising a barrel and a cap, said plunger guide being included in said barrel, and said switch assembly further comprising movable roller means retained by said cap and located in contact with said plunger, for retaining said plunger in said guide and urging said plunger toward said depressed position in response to pressure against said roller means.

6. A plunger operated electrical switch assembly, comprising:

(a) a magnetic reed switch;

(b) means for holding said magnetic reed switch in a predetermined location;

(c) an elongate actuating magnet;

(d) a plunger, including cavity means for receiving said actuating magnet in a selected one of a plurality of positions within said plunger, said actuating magnet being located in one of said positions within said plunger;

(e) a plunger guide, said plunger guide being located adjacent said means for holding said magnetic reed switch and permitting reciprocal movement of said plunger alongside said magnetic reed switch and longitudinally thereof between an extended position and a depressed position; and (f) a housing including said means for holding said magnetic reed switch and said plunger guide, said housing comprising a barrel and a cap, said plunger guide being included in said barrel, and said switch assembly further comprising radially movable roller means retained by said cap and located in contact with said plunger, for retaining said plunger in said plunger guide and urging said plunger toward said depressed position in response to pressure against said roller means, a portion of said roller means protruding radially outwardly through said cap.

7. The switch assembly of claim 1, wherein said plunger is shaped to fit operatively within said plunger guide in either of two alternative positions, a respective one of said magnet receiving cavities being located closely alongside said means for holding a magnetic reed switch when said plunger is located in said guide in either of said alternative positions.

8. The switch assembly of claim 7, wherein the exterior of said plunger is approximately rectangular and said cavity means comprises a pair of parallel cavities extending respectively along diagonally opposite longitudinal edges of said plunger.

9. The switch assembly of claim 8, wherein said plunger has a closed front end and includes means located on said front end for indicating the locations of said first and second magnet receiving cavities.

10. The plunger operated switch assembly of claim 1, further including biasing means associated with said plunger for urging said plunger toward said extended position.

* * * * *